United States Patent [19]

Caporusso et al.

[11] Patent Number: 4,981,030

[45] Date of Patent: Jan. 1, 1991

[54] PORTABLE PIPE BENDING MACHINE WITH ELECTROMECHANICAL CONTROL

[76] Inventors: Alessandro Caporusso; Mario Caporusso, both of Via Pantanelle, 21, Piedimonte San Germano, Frosinone, Italy

[21] Appl. No.: 446,200

[22] Filed: Dec. 5, 1989

[30] Foreign Application Priority Data

Dec. 16, 1988 [IT] Italy ..... 48671 A/88

[51] Int. Cl.[5] ..... B21D 7/04

[52] U.S. Cl. ..... 72/158; 72/149

[58] Field of Search ..... 72/149, 154, 155, 156, 72/157, 158

[56] References Cited

U.S. PATENT DOCUMENTS

| | | | |
|---|---|---|---|
| 3,921,424 | 11/1975 | Pearson | 72/158 X |
| 4,201,073 | 5/1980 | Eaton | 72/155 |
| 4,355,525 | 10/1982 | Carson | 72/149 |
| 4,532,787 | 8/1985 | Caporusso et al. | 72/158 |
| 4,546,632 | 10/1985 | Van Den Kieboom | 72/158 |
| 4,760,727 | 8/1988 | Van Landingham | 72/149 |

FOREIGN PATENT DOCUMENTS

| | | | |
|---|---|---|---|
| 844850 | 7/1952 | Fed. Rep. of Germany | 72/155 |
| 846956 | 8/1952 | Fed. Rep. of Germany | 72/155 |

*Primary Examiner*—E. Michael Combs

*Attorney, Agent, or Firm*—Young & Thompson

[57] ABSTRACT

A portable pipe bending machine to bend pipes up to an angle of 180°, in the range of outside diameters from about 4 mm to 42 mm, and of thicknesses from about 0.5 mm to 2.5 mm. A main carrying structure (11) of a light alloy in the form of a parallelpiped box has a hollow base (12) and two superposed structural component parts (13, 14) wherein a mechanical transmission and drive system and control system are arranged. A cover (14) of the structure (11) has a protruding part (15) providing a support plane (15') as a supporting and sliding base of a rack (16) between parallel side guides for the positioning of a countermatrix die (31). From the cover emerges a main shaft (50) on which a matrix die (30) is rotatable about an axis perpendicular to the rack, the matrix die (30) having for at least about 180° a pulley shape (**30*a*) with a semicircular groove and a perimetral profile having a tangential extension (30*b*) along a feeding direction of a pipe to be bent. The matrix die (30) is assembled for free turning on a cylindrical end (52') of the main shaft (50). The countermatrix die (31) comprises a substantially parallelpipedal body, a side of which has a protruding part (31') provided with a through hole with an axis parallel to that side, for assembling the body on the pin (20) of a slider (19**). An opposite side of this parallelepipedal body has a shape for receiving the pipe to be bent.

7 Claims, 10 Drawing Sheets

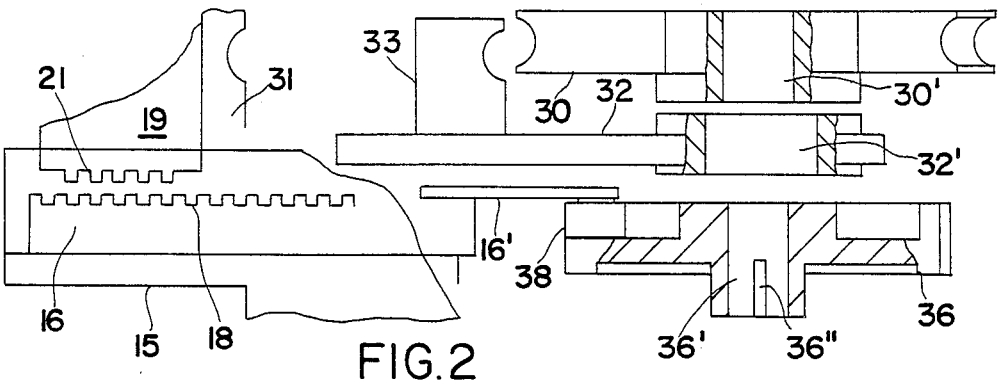
FIG.2
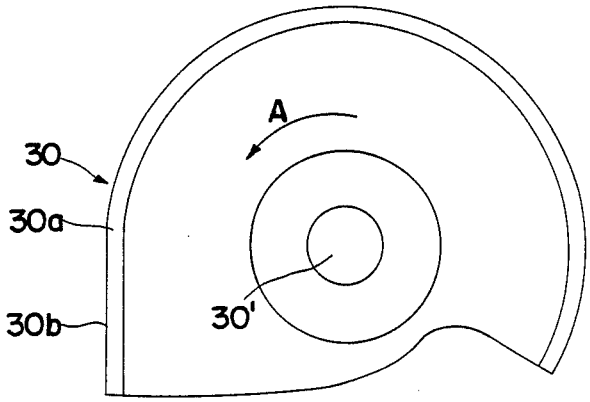
FIG.3
FIG.4
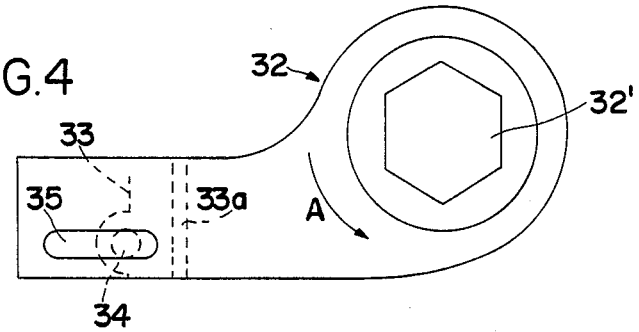
FIG.5
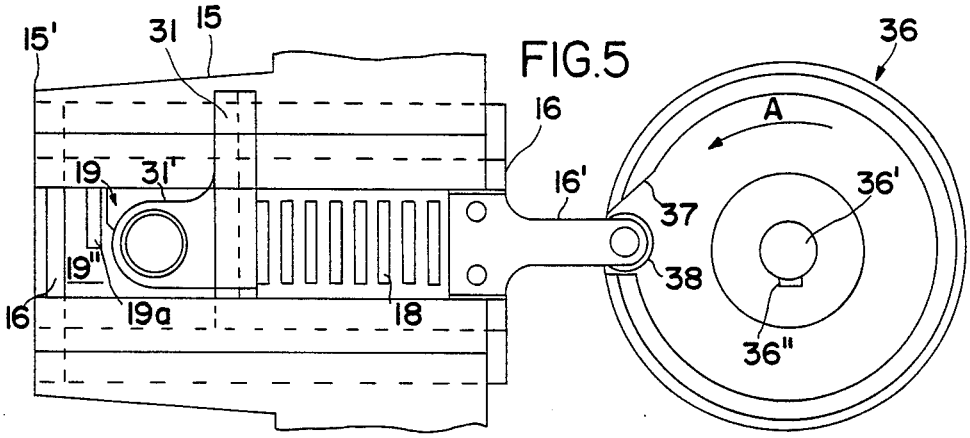

FIG.11
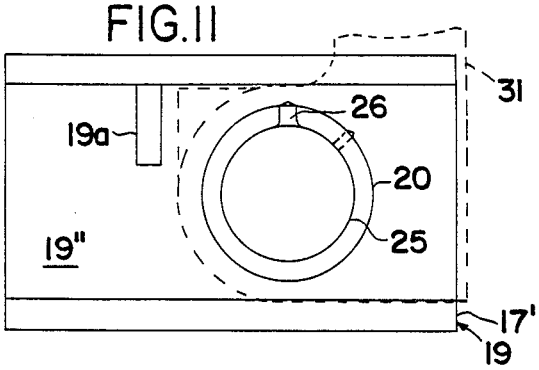
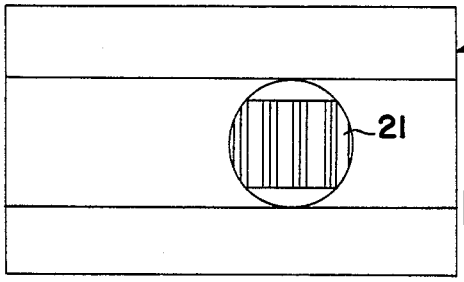
FIG.12
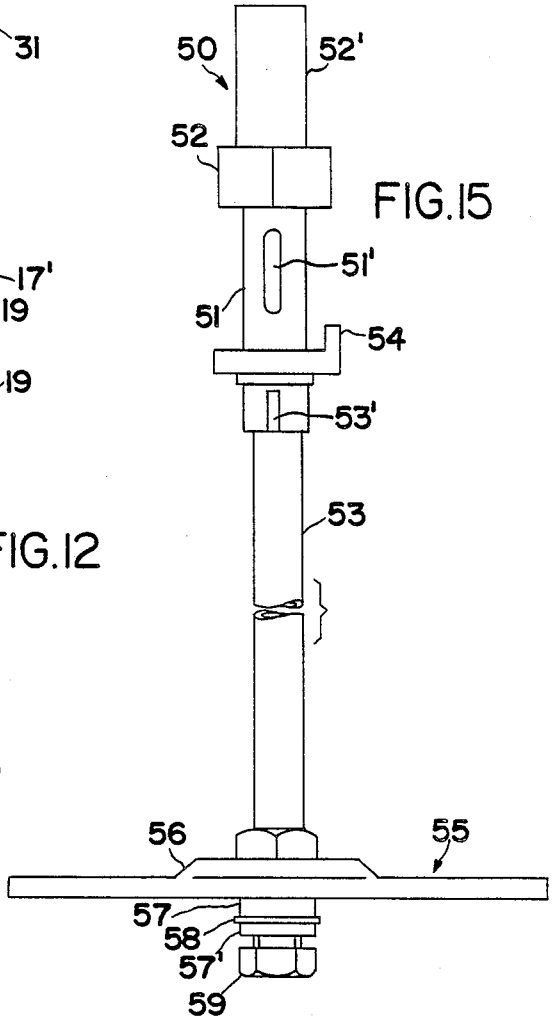
FIG.15
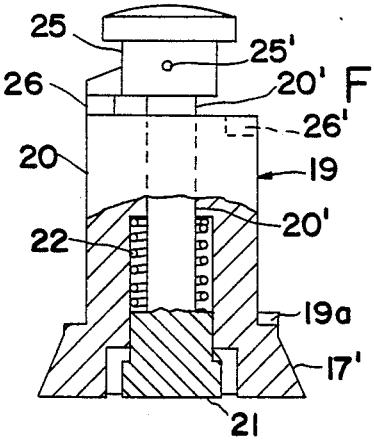
FIG.13
FIG.16
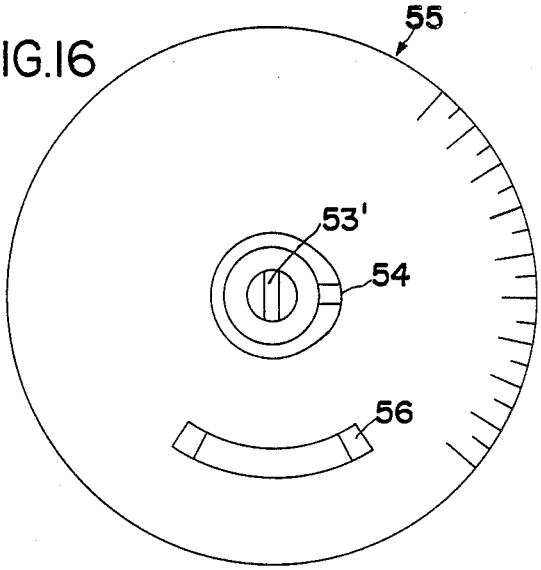
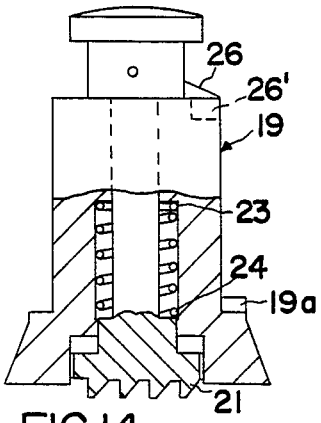
FIG.14

FIG.18
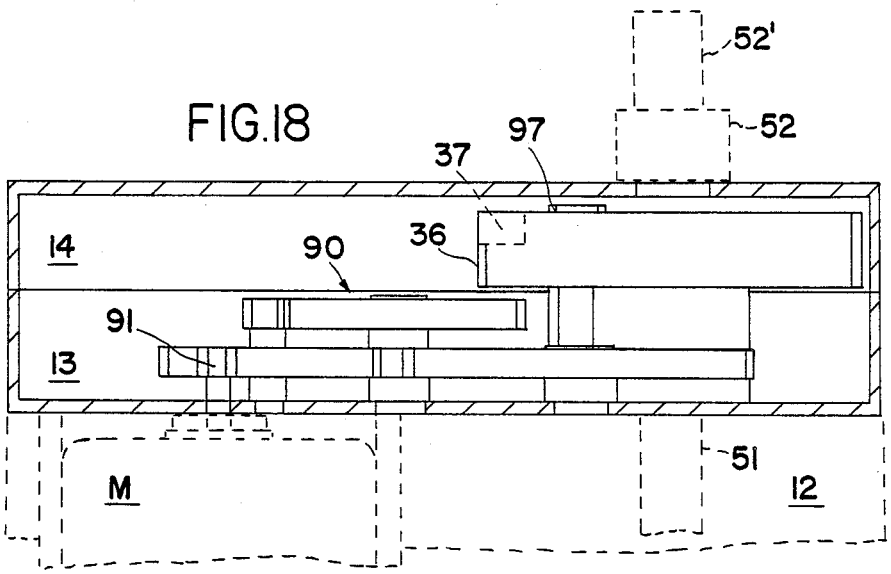
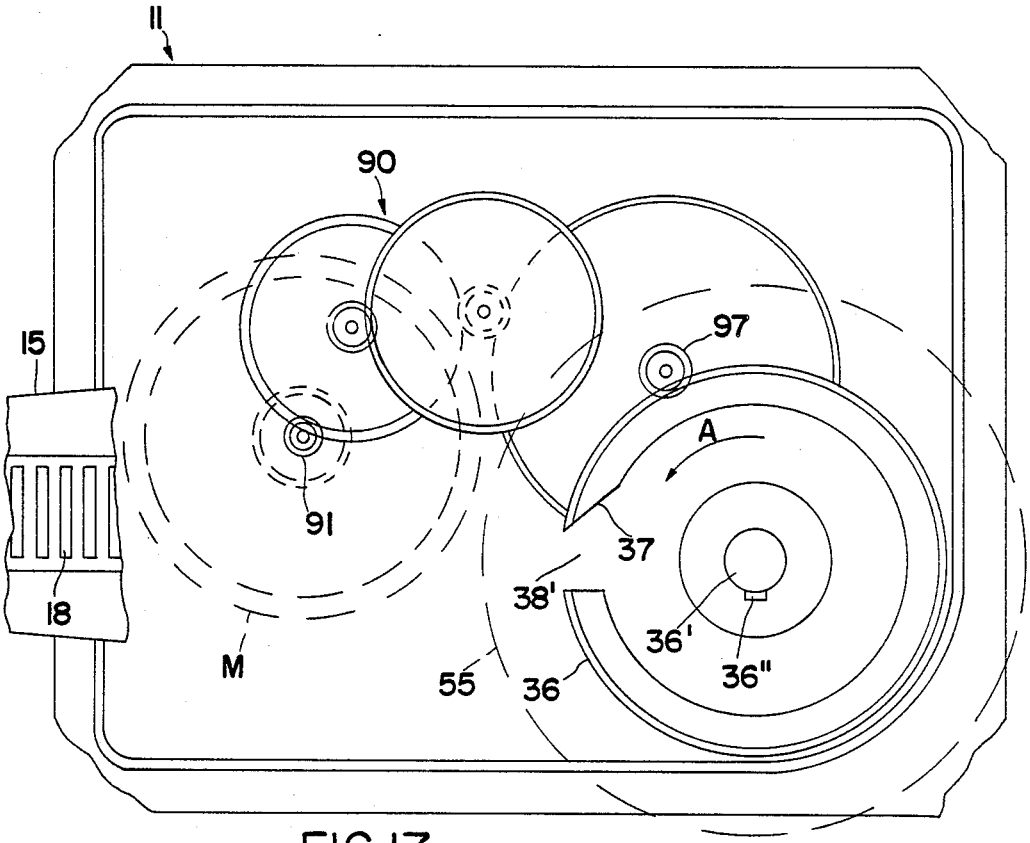
FIG.17

PORTABLE PIPE BENDING MACHINE WITH ELECTROMECHANICAL CONTROL

The instant invention relates to a portable pipe bending machine, with electromechanical control and electronic interlocking, wherein the matrix die is provided with a semicircular groove extending along its particularly shaped outside perimeter, and the countermatrix die is provided with a specially shaped groove which has been already described, illustrated and claimed in U.S. Pat. No. 4,532,787. In this pipe bending machine the arrangement and the movements of the matrix die and of the countermatrix die, the electromechanical control with electronic interlocking, and the use of auxiliary elements and/or organs are described.

From an examination and analysis of the previous methods and techniques it appears that the inventors and the producers did try to improve only one or only some of the building and operating features of a similar pipe bending machine, in order to enable the operator to satisfy the requirements for these machines.

Very interesting solutions have been studied in order to ensure that distortions and deformations, if any, of the pipe submitted to a bending action, and therefore to tensile stresses, may occur within the elastic limits of the pipe, and therefore could remain only for a short while during the bending operation. One has therefore suggested to use some bending organs having a matrix with a groove provided with a certain eccenticity, whose control during rotation was obtained by means of a linear displacement, in turn controlled by means of a hydraulic arrangement, whereas a long countermatrix die was dragged, having a particularly shaped groove, in order to obtain a temporary egg-shaped deformation of the pipe; or otherwise, the bending organs had a matrix die fastened on a shaft and a countermatrix die made up by a toroidal member installed on the pivot of a forked lever, with one end fitted on the matrix die shaft and therefore operated, if required, by hand; or even bending devices for particular uses, for instance hollow section bars, with the use of a core. Many times the control has been arranged by hand, or even by means of some hydraulic devices, for machines and equipment items which can be considered, almost in all cases, as belonging to some different areas and not to the hydraulic-sanitary area which is the field of the instant application, and the applicant does not known that anyone has suggested and/or used machines or pipe bending devices that are really portable, that is to say that can be carried to the place where they must be used, only by hand, and having an electromechanical control, and also being able to respond to the many and different requirements of the operators; on the contrary, such previous devices were only able to respond to one only of the above mentioned requirements, or to some only of them.

The pipe bending machine which is the subject of the instant invention permits bending to 180° pipes of different materials, even those which are very and particularly sensible to the tensile stresses coming about during the bending operation, with pipes which may have a rather large range of diameters, from 4 mm approximately to 42 mm approximately, and also a large range of wall thicknesses, from 0.5 mm approximately to 2 mm approximately. It permits use in situ where the plant is installed, and secures a development of the operations without causing any breaking of or damage to the pipe, not even invisible damage, or wrinkle lines, or pipe constriction, taking into account the positive and favorable action of the special form of the countermatrix die on the pipe being bent and which is subjected therefore, only for a short while, to the elastic deformations which disappear when the pipe no longer has contact with the groove of the countermatrix die.

This summary highlights the novel features of the pipe bending machine of the instant invention, which features can be listed in the following way:

A. Structure and portable features of the machine, in the sense of an easy transport of same by hand to the working spot, and the possibility to place the machine on a work bench or a flat surface whatever, or otherwise to place the said machine on a base installed on a tripod, in order to perform an orientation movement and/or a different inclination;

B. Electromechanical control of the machine, and electronic interlocking, with gearmotor and with a gear train, in order to obtain a strong speed reduction from the motor to the main shaft, for the rotation of the matrix die and with a circuit system wherein there is a logical interlock suitable for a previous adjustment by hand of the bending angle by means of an appropriate disc with graduation, having thus a particular importance when one needs to obtain an exact presetting of the bending angle with one degree approximation, by using the photo-detectors;

C. A special perimeter profile of the semicircular groove matrix die, which is free to turn on the cylindrical end part of the main shaft and is partially faced by a supplementary support having a semicircular groove which is installed on a component part coaxial with the matrix die, being however rotating as one piece with the above mentioned shaft, in order to cause the rotation and drag of the matrix die in its operation, and in order to clamp automatically the pipe between the counterposed grooves of the matrix die and countermatrix die;

D. Countermatrix die with the special profile of its groove according to the above mentioned patent, however installed on a slider being able to slide between parallel radial rails to and from the matrix die, and being also able to have a serrated coupling with a rack, in order to fix the active position of the countermatrix die with reference to the matrix die;

E. Connection between the rack and the gear wheel being coaxial with the main shaft in accordance with the point C, in order to be able to displace automatically the rack, and therefore the countermatrix die, into its active position;

F1. Pre-adjustment of the bending angle by making use of a graduated disc, which is installed by friction drive on an extended part of the main shaft, and is displaced by hand for the desired pre-adjustment of the bending angle, said disc being provided with cams being able to operate with switches of the electric system with electronic interlocking;

F2. Pre-adjustment of the bending angle by means of photo-detectors of the electric system with electronic interlocking;

G. Auxiliary supports of the pipe which must be bent along its axis with the double purpose as follows: to previously fix the linearly consecutive positions where the pipe bending must be made; to previously fix the selected consecutive planes for bending, angularly different from a basic plane, said above mentioned planes being such, that they must pass through the axis of the pipe.

As it's possible to see, the invention comprises a number of novel features aiming to give to the operator the power to pre-adjust and to perform in a reliable manner the different operations in the area of pipe bending, as they can be performed on the spot. From a construction point of view, the interchangeable bending organs are designed with the centres of the mutually facing grooves on a plane at a constant level with reference to the supporting structure of the machine, whatever the diameter of the pipe to be bent may be.

In order to better understand these novelty features, in the following lines we describe a preferred example of realization of the invention, with reference to the accompanying drawings wherein:

FIG. 2 is a schematic view of the most important component parts of the pipe bending machine, showing components according to C - D - E, at a certain distance but in a coaxial order;

FIG. 3 is a schematic view in plane and from the top, of the new matrix die, in accordance with the invention;

FIG. 4 is a schematic view in plan from the top of the component part foreseen for the installation, in rigid connection, on the main shaft of the machine;

FIG. 5 is a schematic view in plan, and from the top, of the gear wheel belonging to the gear train directly and rigidly connected with the main shaft and directly connected with the rack component part and therefore with the slider carrying the countermatrix die, in accordance with the point D;

FIG. 11 is a plan view from the top of the movable slider carrying the countermatrix die;

FIG. 12 is a plan view from the bottom, of the movable slider according to FIG. 11;

FIG. 13 is a schematic elevation view, partially in cross section, of the slider according to FIG. 11, with the corresponding lower teeth in a disengaging position with reference to the rack;

FIG. 14 is a schematic elevation view, partially in a cross section, of the slider according to FIG. 11, with its lower teeth engaged with those of the rack;

FIG. 15 is a detail schmatic view, in elevation, of the controlling shaft of the matrix die, carrying a graduated disc as a first example for the manual pre-adjusting of the bending angle;

FIG. 16 is a plan view from the top, of the pre-adjusting disc according to FIG. 15;

FIG. 17 is a schematic plan view from the top, of the gear transmission system;

FIG. 18 is a schematic view in elevation of the gear train according to FIG. 17;

Figure 1:
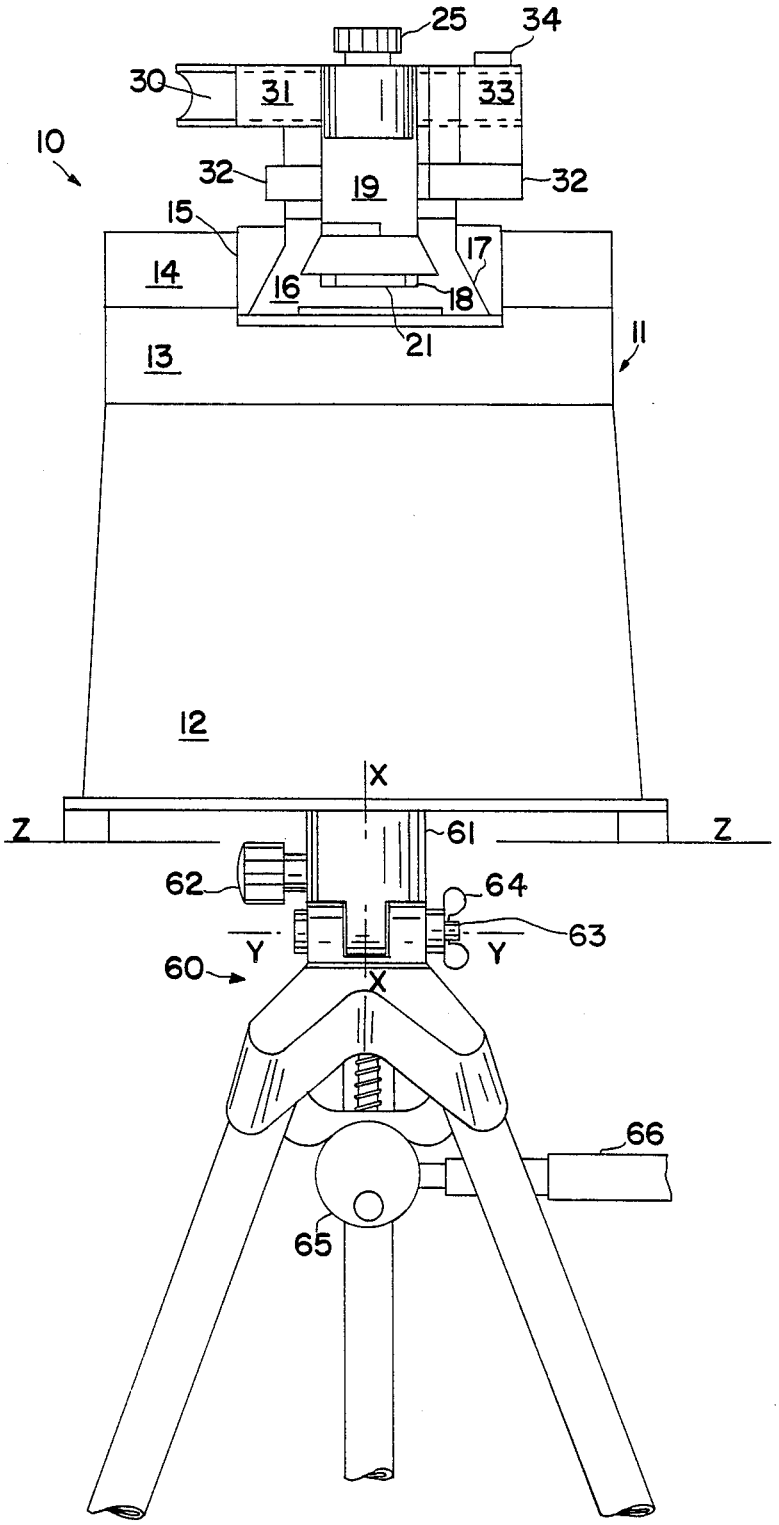
FIG. 1 is a schematized view of the whole, from one side, of a pipe bending machine in accordance with the invention, installed on a tripod.

Passing now to the study of the above listed drawings, and first of all to FIG. 1, one must remark that the portable machine, the subject of this invention, and indicated with the reference number 10, consists of a light alloy carrying structure 11, in form of a parallelepiped box, with a hollow lower part 12 wherein the motor, the electric system and the electronic interlocking are installed, and with superposed components 13 and 14 where there is the due space for the gear train transmission system. The machine can be placed on the working place, on a Z—Z plan or otherwise, as it is illustrated in FIG. 1, mounted on a tripod support 60 through a joint member 61–63.

The interconnecting element 61 allows the machine to turn around a vertical axis X—X, and additionally, to perform angular movements around the junction axis Y—Y corresponding to the threaded end pivot 63', between the lugs of the interconnection element 63; it permits also locking the machine in the preferred position by means of the wing nut. In order to enjoy maximum portability and also to extend the range of diameters and thicknesses of the pipes to be bent, the weight, the volume and the power of the controlling motor have been reduced to the minimum possible, whereas the control power in turning the matrix die as bending organ has been increased.

For this pipe bending machine the use of an M motor with approximately 1,000 W, and with turning speed 25–26,000 rpm has been provided. The speed reduction therefore is very high in order to have the bending organ turning at 3 to 5 rpm only, however with a power of bending clearly very high, suitable indeed to operate not only with small diameter (4 mm) and small thickness (0.5 mm) pipes, but also with pipes reaching even 35 to 42 mm diameter, and with thickness of 2 to 2.5 mm approximately, particularly of soft copper. Such a high speed reduction is obtained by means of a gear train 90 which, in accordance with the illustrations of FIGS. 17, 18 and 21, 22, passes from a pinion 91 of the above mentioned motor M to a spur gear 36 installed rigidly on the main shaft 50, on whose end part 52' there is installed, in turn, freely, the interchangeable matrix die 30 of the machine.

Both the electric circuit system and the electronic interlocking are provided also for the pre-adjustment of the bending angle.

Figure 19:
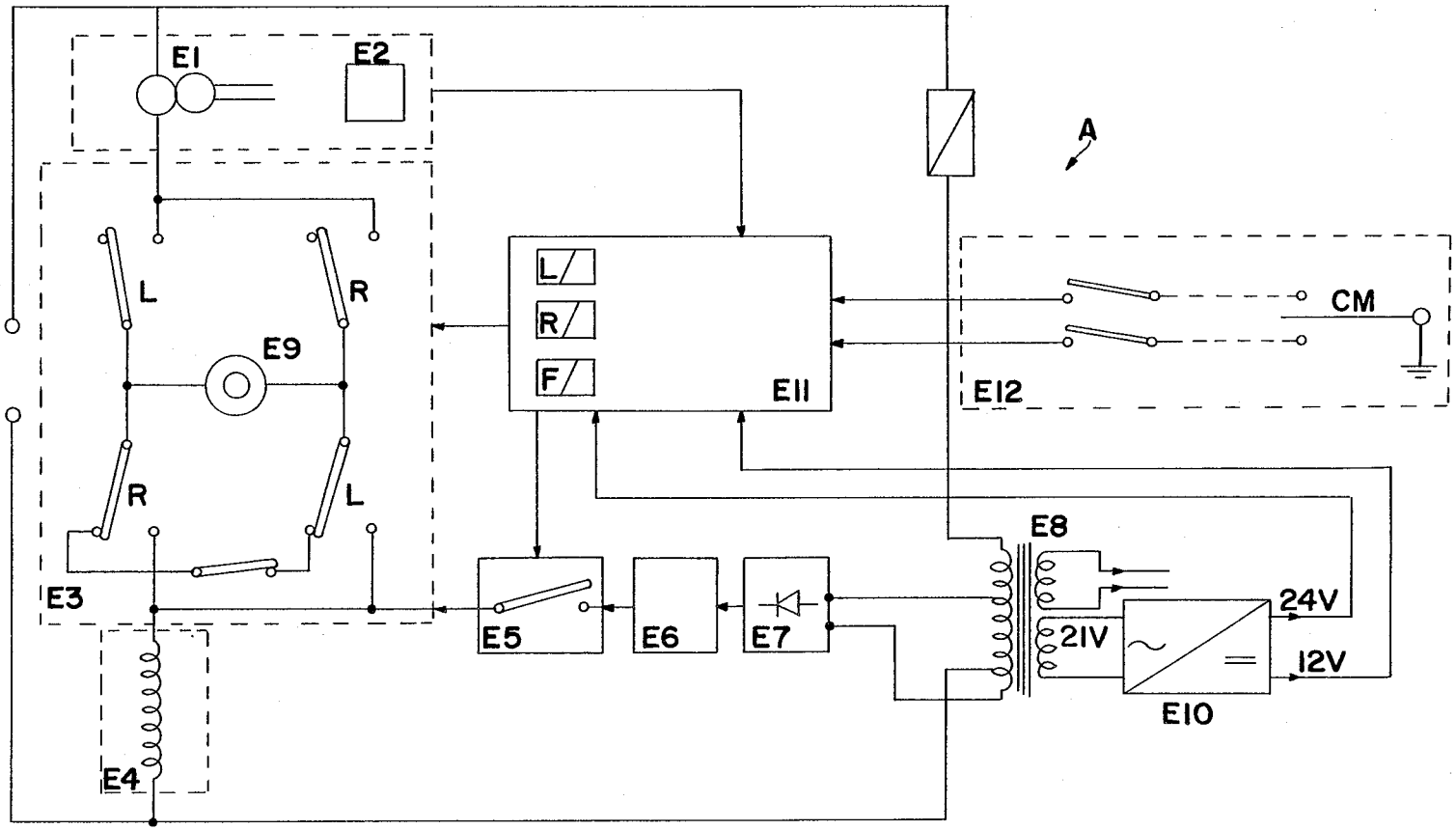
FIG. 19 is a scheme of the electric circuit system with electronic interlocking, for a pipe bending machine with disc pre-adjustment of the bending angle.

The electric circuit system to control the pipe bending machine 10, with electronic interlocking, is described in the following with reference to FIG. 19, for the case of a disc preadjustment, as it has been indicated before, and in FIGS. 21–22 for a manual pre-adjustment; and in the latter case the gear transmission train is more clearly mentioned. In FIG. 19 is shown the current protection provided by means of the amperemetric transformer E1 and a timer E2 tending to secure the proper entry into action of the above mentioned protection.

The reversal turning system includes the group E3 with the switches L, R which operate respectively in forward and reverse for one or for the other of both running directions of the motor which shall operate the control wheel 36 to bend a pipe p, and for returning the bending organs to their starting position.

In this scheme of the circuit, the current coming from the network line passes to the transformer E8 through an ordinary fuse, passes then into the rectifier E7 and then into the braking adjuster E6, with a subsequent passage to to block E5 which represents the connection of the exciter current of the motor field E4 for the braking operation.

In the block E3 with E9 is indicated the control rotor of the speed reducer for the mechanical transmission system 90, and a timer has been provided in order to define the exact insertion time of the current in one or in the other of both running senses, in order to ensure that the braking action is kept according to the schemes, and to avoid a change of the running sense, even if unintentional.

When one observes the circuit scheme A of FIG. 19, one may remark that in the case of a pre-adjustment of the bending angle by means of the disc 55 (see FIGS. 15 and 16) it is preferable to have a secondary of 21 V for the transformer E8, with outputs in direct current of 12 V and 24 V from the rectifier E10 for the logic interlocking E11 as provided for the conditions L, R, F (respectively: operation, reverse, braking).

To the logic interlocking E11 arrive also the cables which from a manual control CM, placed either on the pipe bending machine or at a certain distance with a pedal switch, come from the respective switches which are interposed on the lines.

Figure 20:
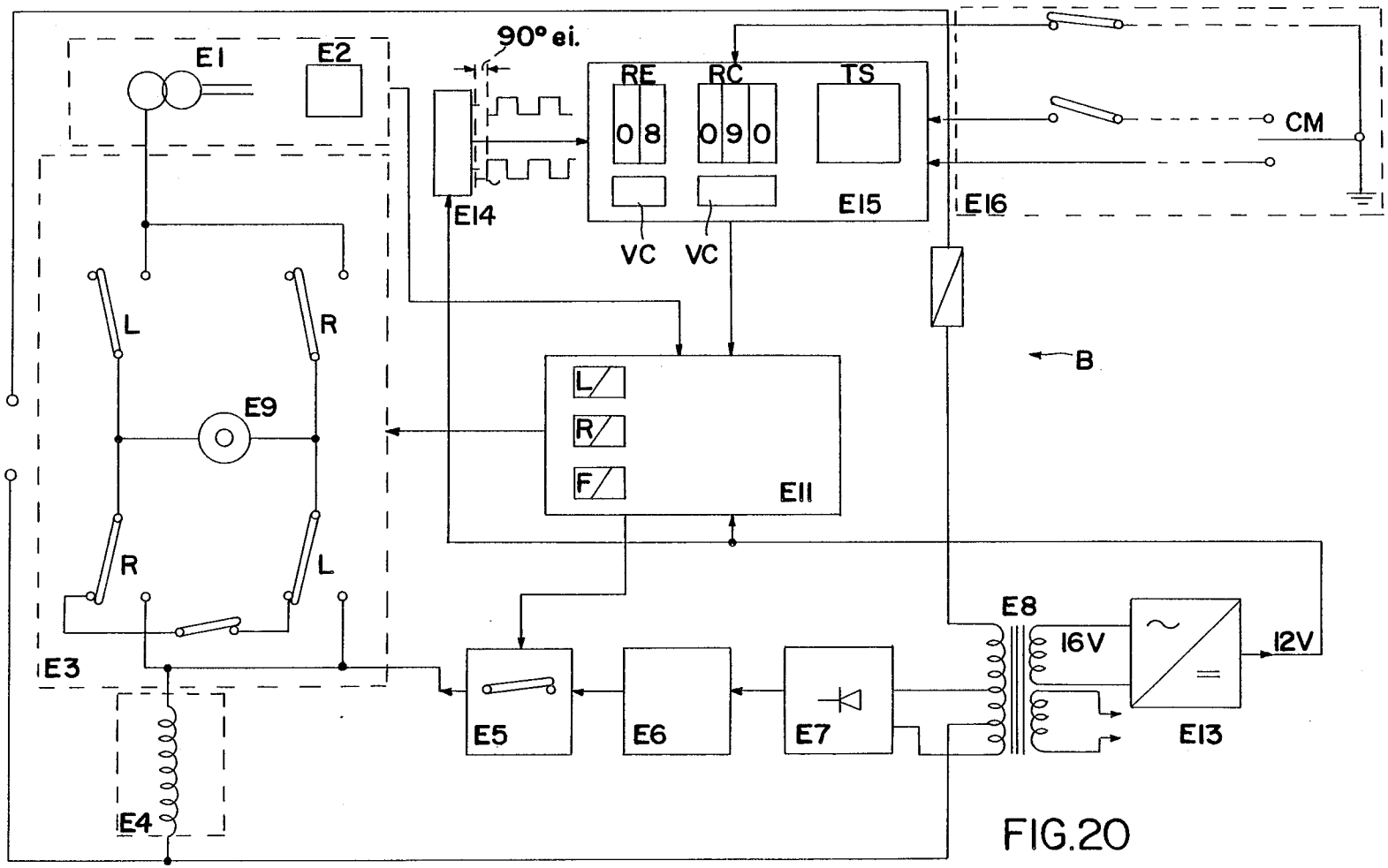
FIG. 20 is a circuit diagram in accordance with FIG. 19, of a digital pre-adjusting device of the bending angle.
Figure 21:
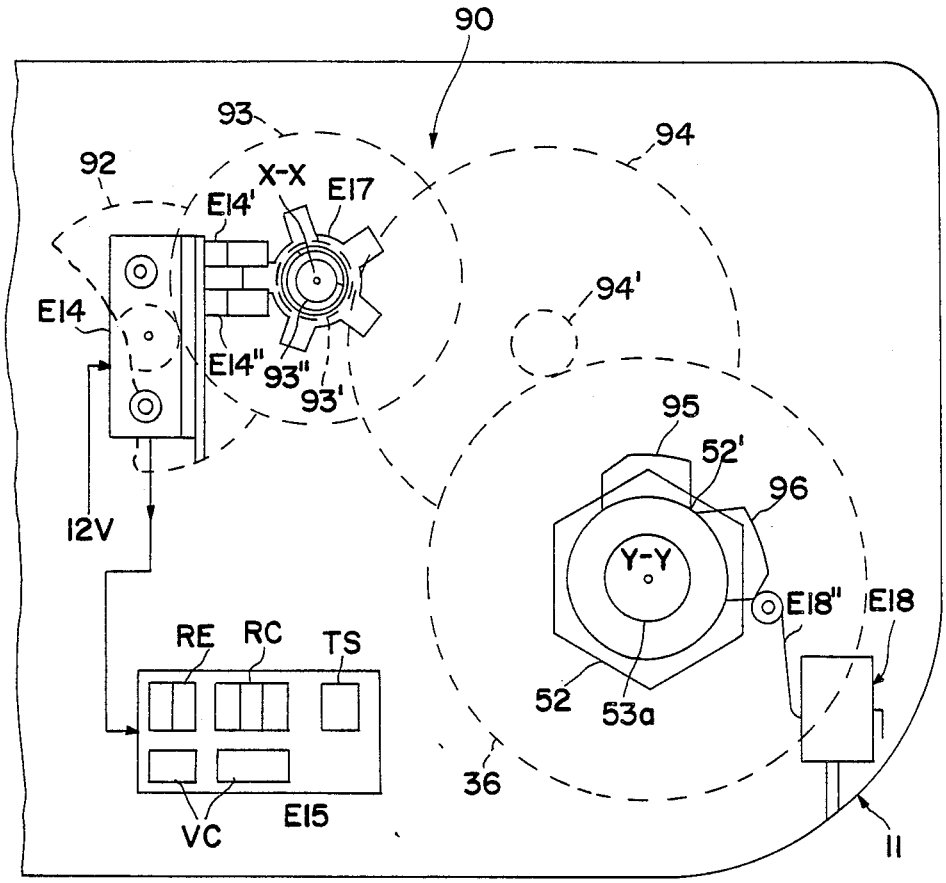
FIG. 21 is a schematic plan view of the circuit components arrangement in accordance with FIG. 20.
Figure 22:
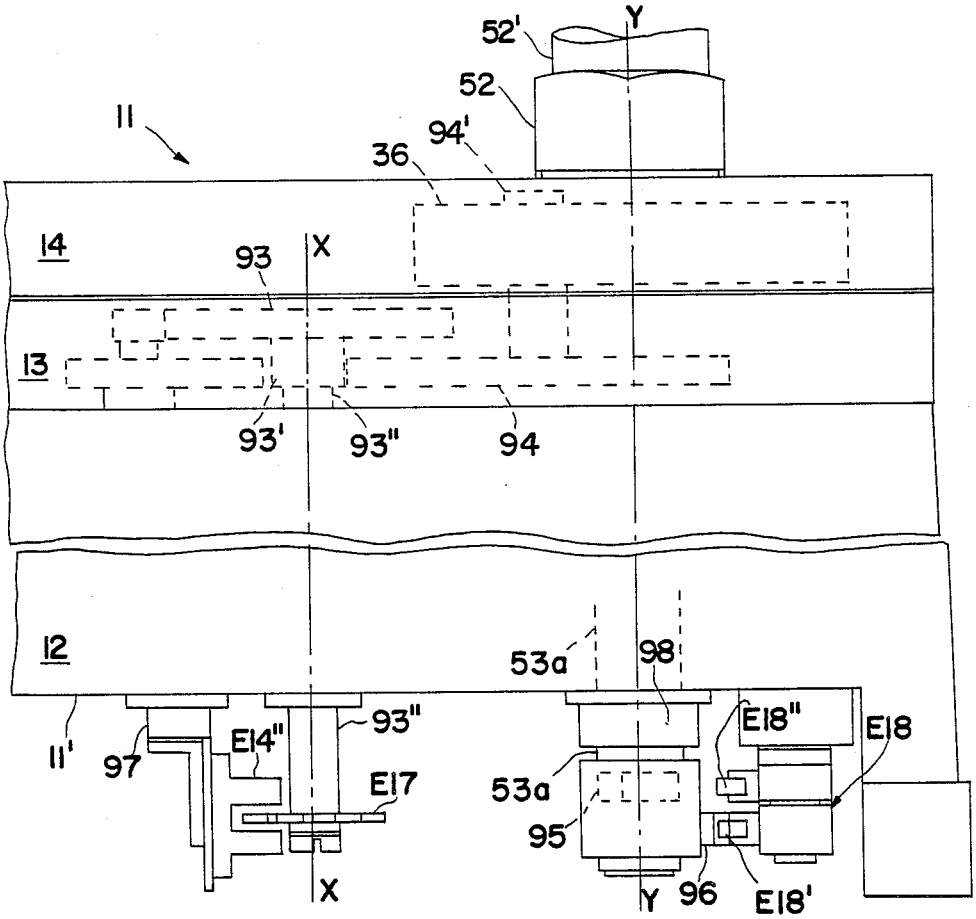
FIG. 22 is a schematic elevation view of the arrangement of the circuit components in accordance with FIG. 20.

Particular attention must be given to the digital pre-adjustment and the electronic interlocking; for both of them the circuit system B is indicated in scheme in FIG. 20, whereas some details of the component parts which form the same are represented in FIGS. 21 and 22, in their possible positioning in the same pipe bending machine 10.

The digital pre-adjustment has, as its main purpose, to give the maximum possible precision to the bending angle one intends to have for each operation and obviously to confirm such a precision of the said angle in case there is a number of consecutive bending operations. For this purpose a couple of pulse-detectors E14'—E14" has been provided; they form an interlocking component E14 of the system, which pass to the component E15 some square wave signals staggered by 90° one from the other. The component E15 consists of a subcomponent RE which has the task to correct that error which is generally due to the angular lag which after starting of the rotation of the shaft bearing the matrix die 50, occurs before the real bending of the pipe really starts, as well as due to the angular lag of the above mentioned starting as a consequence of the material elasticity, or also eventually depending upon the mechanical system. These are all errors which can be all evaluated by the operator through experiments, perhaps with only one preliminary pipe bending test for the pipe which must be used.

The pre-adjusting angle is indicated, with an auto-action, in the sub-component RC; since both RE and RC are formed by conventional numerators as digital microswitches, selected for the respective surveys, and must be put into action by the operator in order to place both the error correction angle on RE, as it has been specified here above, and also the bending angle one intends to obtain, on RC.

From the circuit scheme B of FIG. 20 one may remark that the digital pre-adjuster E14–E15 is fed with direct current at 12 V from a secondary winding at 16 V of the transformer E8 and through the rectifier E13. One may notice also that the E15 component is provided also with the VC visualizers, respectively for RE and for RC, and by means of them the operator can visually follow the variation of the matrix die angle during the bending operation, as will appears more clearly hereinafter.

In FIGS. 21 and 22 the component elements of the electronic interlocking in their assembly positions on the pipe bending machine 10 in accordance with this example of realization are schematically shown.

First of all, one has supposed a pre-adjustment of the bending angle with the precision of one degree, and more exactly a bending of 360° for each turn of rotation of the matrix die 30. One has also supposed that the speed ratio between a gear wheel 93 of the gear train 90, which has been selected for the assemblage of E14–E15, and the gear wheel 36 of the shaft of the matrix die 30 should be 72:1, and further that a disc E17 with five wings permits accordingly five signals for each turn on the shaft X—X of the wheel 93 on which the disc E17 is assembled, and according to the above $72 \times 5 = 360$ signals for each revolution of the matrix die on the Y—Y axis. With reference to FIG. 22, the component part E14 together with its pulse detectors E14'—E-" has been assembled on a support member 97 which is externally fastened on the basic part 11' of the 11 structure, whereas the five wings disc E17 is integrally assembled on the shaft 93" of the gear wheel 93 with turning axis X—X. On the above mentioned base 11' a support 98 is fastened, in order to have the free turning on the shaft of the matrix die part **53*a*, which in turn offers an integral support for rotation to the shaped extensions 95 and 93**; on the outside borders of these the ends, provided with rollers, of the corresponding forward and reverse limit micro-switches are able to have their rolling path, thus enabling the matrix die to perform their functions.

In this manner the problem of the pre-adjusting precision for the bending angle of a pipe has been solved through a proper system of photo-detectors E14, in both directions and with the only requirement of a simple five wings disc, which is assembled, according to the above mentioned points, on a shaft X—X having the ratio 72 to 1 on the shaft Y—Y.

One has decided therefore, to avoid the use of an encoder which in this particular application cannot be considered a reliable item, above all because of the different stresses, and also for the noises in the magnetic field, as they could be generated by the motor with a collector ring, which has been considered the best one for this pipe bending machine.

The operation of this digital preadjusting device of the bending angle can be summarized as follows:

When the matrix 30 of the machine is at the end of its return run, the contacts of the run's end microswitch are, as a consequence thereof, open, and this stops the motor M and causes the resetting of the counters RE and RC.

Before starting a pipe bending operation, the operator sets on the RE counters the error correction angle, according to the previously mentioned points, and on the RC counters the bending angle it is desired to obtain. The start of the pipe bending operation happens when the contacts of this microswitch are closed and when the RE counter for the error correction is operating; this counter is locked at the end of the said correction, and simultaneously it energizes the counter RC on which in the pre-adjustment step, one did set the predetermined bending angle, to be made on the pipe. As soon as this angle has been obtained, the operation is automatically stopped for some seconds in accordance with the intervention of the timer Ts, and the operator therefore has the time to leave the control lever free.

It is important to remember, at this point, that the bending angle as it is from time to time obtained, can be observed by the operator, by looking at the VC visualizer; and in case the preadjustment angle as it has been set on the RC counter is not yet obtained, this being possible according to an unintentional or deliberate stopping of the operation, the operator can reactivate the pipe bending machine even for one degree only, because the machine shall be automatically stopped when the angle, which has been set on the RC counter, shall have been obtained. It is also very interesting to notice that in case an unintentional turning of the matrix die shaft in the reverse sense happens, due for instance to the pipe elasticity in the bending step, a turning angle in the reverse sense of the above type is not going to cause an error in the final bending angle, since the counter is bidirectional, and therefore it takes into account the turning angle or angles of the matrix die shaft in the reverse sense as well as the bending sense.

It is generally foreseen in the pipe bending machines or devices, to make use of an interchangeable bending body, or matrix die, as the sole part revolving on its own shaft directly controlled by means of a mechanical or electromechanical system; on the contrary in the present invention the bending body is made up by two different and separated parts, that is to say the downright matrix die 30 (FIGS. 2, 3 and 6) installed and freely revolving on the upper cylindrical terminal part of the main shaft 50 (FIG. 15) and a cooperating component part 32 (FIGS. 2 and 4) having an excentric hexagonal hole 32' to be assembled on the corresponding hexagonal length 52 of the shaft 50 and therefore integrally turnable with the latter part, the main shaft, which in turn is brought to rotation by the gear wheel 36 of the gear train 90 under control of a motor M (FIG. 17), to be better explained in the following, as the organ starting and driving the whole mechanical transmission in the operational bending steps.

Figure 6:
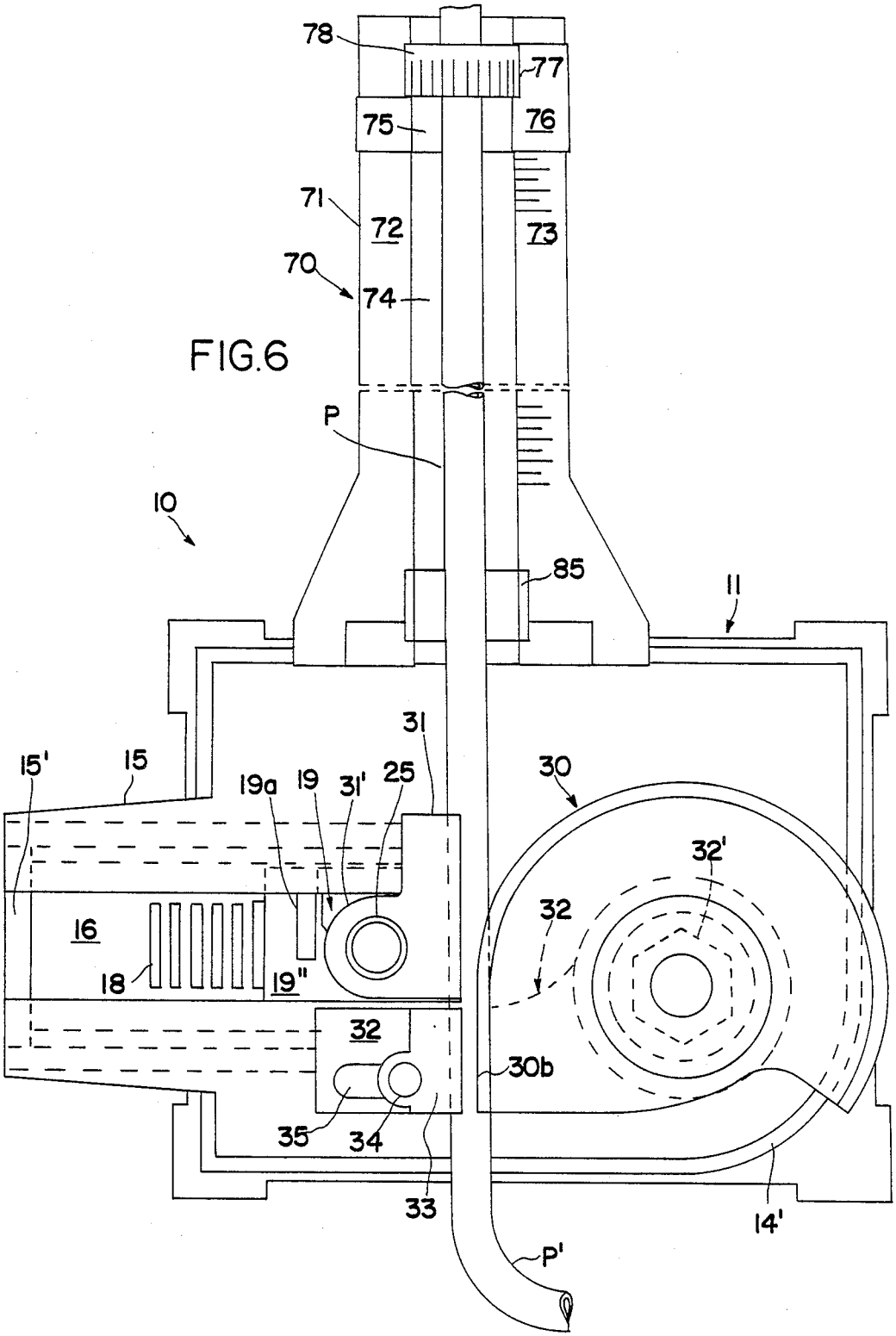
FIG. 6 is a schematic view in plan and from the top side, of the machine of the invention, with the bending organs, in accordance with C - D - E in a position to start a bending operation, and with the auxiliary pipe supports according to E.

When one observes the FIG. 6 it will be noted that the cooperation between the grooves of the matrix die 30 and of the countermatrix die 31, in order to obtain the bending of the pipe p, is performed substantially during turning of the matrix 30 between its groove having a semicircular cross section 30*a* an the special form in cross section of the groove of the countermatrix die 31 in accordance with the above identified patent, with only momentary elastic deformations and with a characteristic "ovalization" in the length of pipe which, even if it is stressed in the above manner, resists the tensile stresses, in such a manner that it comes back to its original, circular cross section when the operation comes to its end without breaking or damage, even if not visible, or pipe compression, or wrinkle lines.

Figures 7, 8, 9, 10:
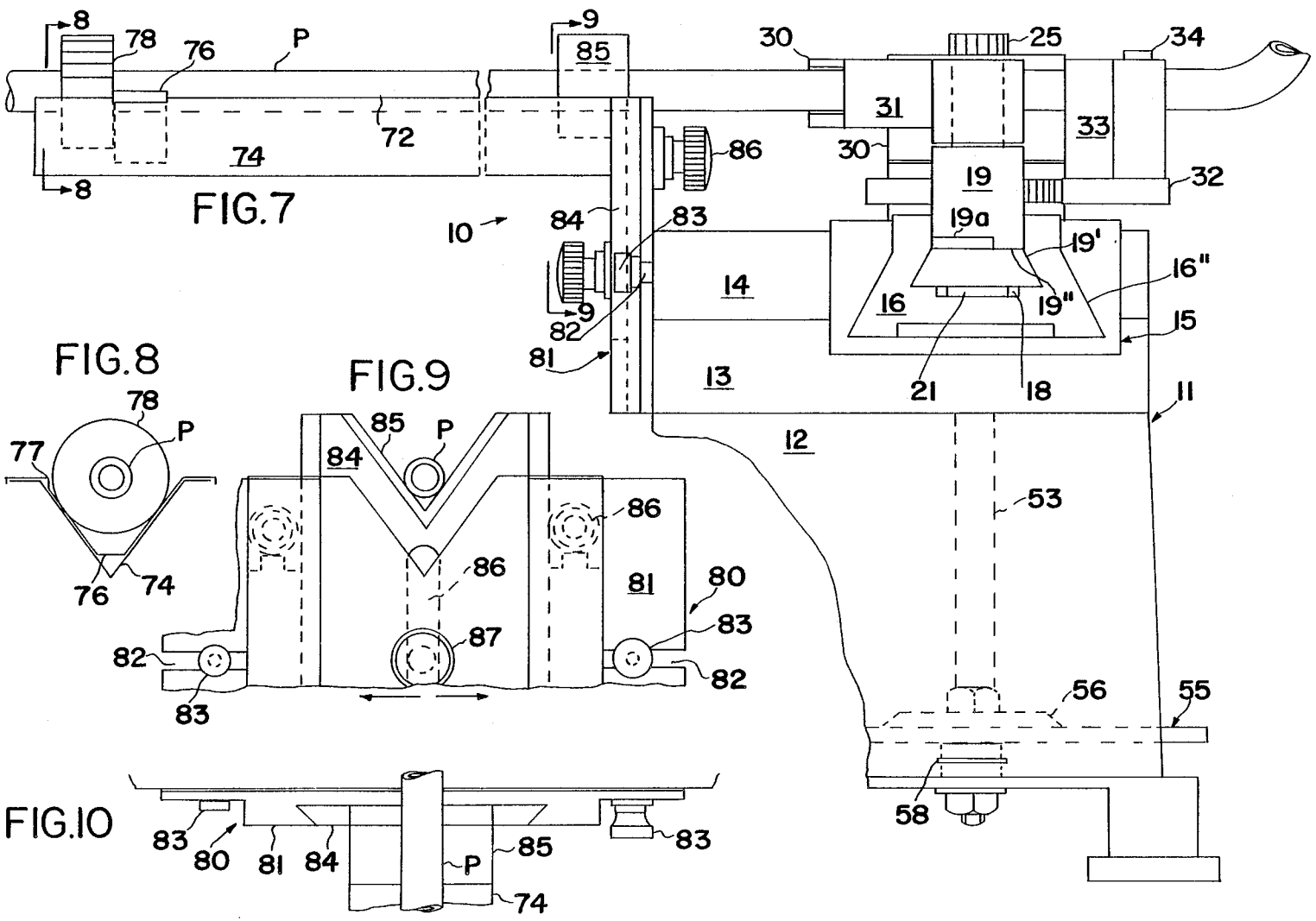
FIG. 7 is a schematic elevation view, from a side, substantially corresponding to the schematic view of FIG. 6.
FIG. 8 is a view in cross section in accordance with the plane of the line 8—8 of FIG. 7.
FIG. 9 is a front view of the central adjustable support device of the pipe to be bent, seen from the plane of the line 9—9 of FIG. 7.
FIG. 10 is a schematic plan view from the top of only the central adjustable supporting device of the pipe to be bent.

The carrying structure 11 of the pipe bending machine 10 is provided with a removable rack, 16, in the central zone of the prominent part 15, and for the movement thereof in a direction normal to the axis of the pipe p to be bent the body of the rack 16 has a form like a dovetail 16', as shown in FIG. 7. The movement of the rack 16 along the opposite supporting guides provided in the prominent part 15 of the carrying structure 11 is automatically followed to the matrix die 36 and on the plane 15' of the prominent part 15 by virtue of the connection between the rack and the controlling gear wheel 36, a connection that, in this example to carry out the invention, provides a junction bar 16' at whose free end a wheel 38 is installed, said wheel being in operation on the inside profile of the controlling gear wheel 36, by following the inclined length 37 to continue on this profile, when the controlling gear wheel has the active counterclockwise sense A of turning. Even if this easily understandable, it should be noted that the controlling gear wheel 36 brings with it and causes to rotate the controlling main shaft 50, because of the key connection 51' 36'' (see also FIG. 15) between these component parts, and also the cooperating component parts: matrix die 30 and part 32, according to the above mentioned points.

This feature, already for itself important of the removable rack 16 for its automatic positioning when coming nearer to the matrix die 30 permits moreover fulfilling two more aims which are interesting too, and more exactly: to bring as near as possible the countermatrix die 31 to the matrix die 30 when between the respective facing grooves the pipe p to be bent is interposed; to place automatically the countermatrix die 31 into its position of starting the bending operation (FIGS. 5 and 6).

The countermatrix die 31 provided with the already described special groove, illustrated and claimed in the above-identified patent is not, according to the instant invention, an independent component part being placed manually into its position. It belongs as a part, to another part to be assembled on the cylindrical body 20 of a slider 19 which in turn has its base part, rather long, formed with opposite longitudinal sides 17' of dovetail form, to be placed and removed along corresponding parallel dovetail guides 19' (FIG. 5) provided in the rack 16. The cylindrical body 20 of the slider 19 is provided with a through hole along its axis for the passage and the sliding along it of a shaft 20' having, as its own body, an end length of larger diameter from whose lower outside surface protrude teeth 21 having a shape and pitch suitable for coupling with the teeth 18 of the rack 16. The through hole has a lower end (FIG. 13) of a larger diameter corresponding to the lower internal diameter of the shaft 20'. In order to ensure that the pivot shaft 20', with its own end and the relevant teeth 21, can be carried to an active coupling mesh with the rack 16 (FIG. 14) or into an inactive position for the free displacement of the slider 19 along the guides 19' of the opposite longitudinal sides 17', it is provided with a hand grip 25 fastened on the above by means of a pin 25' and of a protruding element 26 thus enabling the operator, respectively, to cause that the teeth 21 may be pushed out to obtain the meshing of same with the teeth of the rack or otherwise to retract the terminal part of the pivot pin 20' by causing that the latter slides into its own hole; and this by releasing or by compressing the compression spiral spring 22 provided between the shoulder 23 of the axial hole and the annular projection 24 of the lower end of the pivot pin 20'. By means of an appropriate turning of the hand grip 25 the operator is thus enabled to operate for the sliding of the pivot pin 20' along the axial hole in such a way as to reach the first of these positions following the insertion of the protruding element 26 into the appropriate notch 26' (FIG. 14) and the second position, by placing said element on the upper outside border of the cylindrical body 20 (FIG. 13). It is important to add, at this point, that from the upper plane 19" of the lengthened base of the slider 19 emerges a short length 19*a* with unitary body in the position which is considered useful and sufficient to stop the counterclockwise angular movement of the countermatrix die 31, which, as it is known to the experts of this technical branch, is generally obtained because of the pushing of the pipe to be bent against the groove of the countermatrix die 31 at the beginning of the bending operation, when the pipe is positioned between the above mentioned groove and the groove of the matrix die 30 and it tends therefore to buckle against the bending stress. The innovation according to the point C above, and particularly the locking of the pipe p between the mutually facing grooves of the tangential extension 30*b* of the matrix die 30 and of the auxiliary support 33 installed on the cooperating part 32 tends obviously to lower this pushing which shall have an even better contrasting force and also a nullified effect by virtue of the auxiliary support 85 (see FIG. 6) which is going to be described later.

Coming back now to the automatic positioning of the rack 16, and thus of the countermatrix die 31 in order to start the bending operation, it shall be easily understandable for the technicians of this branch the fact that, to a proper choice of the slope of the starting length 37 at the mouthpiece of the inside perimetral border of the controlling gear wheel 36, shall correspond the automatic, necessary displacement of the rack 16 towards the matrix die 30 and the consequent automatic positioning of the countermatrix die 31 installed on the slider 19, which is made integral with the rack 16 for the regular performing of the bending operation of a pipe p.

If we pass now to the pre-adjustment of the bending angle of a pipe p, manual operation in accordance with the point F1 involves the use of a horizontal disc with graduation 55 installed on a protruding part of the main shaft 50, said protruding part being integral with the above by means of a conventional coupling 53'. As is shown in detail in FIGS. 15 and 16, and also as is shown in broken lines in FIG. 7, this disc 55 can perform a friction conditioned angular displacement around the shaft 50, for instance by using a friction bush all around the main shaft 50, a friction washer 58 and a centering bush 57. The nut 59 is a self-locking one, and the whole unit gives to the operator the possibility of setting by hand the pre-adjustment disc 55 by ensuring that the angle of the graduation corresponds with a fixed pointer for reading.

The disc 55 is provided with a protruding part in the form of an arch 56 with an access incline 56' which causes the spreading apart of a contact face of the corresponding switch (not represented in the drawing) in order to cause the stopping of the bending operation when the pre-adjusted angle has been obtained. A similar circuit cutoff is provided by means of a return end switch (not represented in the drawing) for the cooperating component parts 30–32, in other words the matrix die and the pulling part of same when turning; this cutoff is due to the appropriate cam 54 which is integral with the main shaft 50, whereas its position is already well defined at the time of manufacture.

The novel feature of the invention, already mentioned at the point G, can have a particular importance in all cases of the pipes to be bent having a small diameter and also a small thickness, however without considering as an absolute condition the dimensions of the pipe to be bent.

On must state, first of all, that the use of some auxiliary supports of the pipe achieves two main purposes: 1. to secure a rectilinear support for the pipe to be bent in accordance with the initial bite line between the component parts 30 and 32 even for a relatively long part of the pipe—even two meters—which is particularly useful in the cases of pipes with a small diameter and with a small thickness, which preferably are subjected to a bending with an inside core; 2. to improve the operator's actions by enabling him to easily predetermine the lengths of the pipe which are later subjected to the bending operation; 3. to enable a correct and easy turning of the pipe around its own axis in accordance with some predetermined turning angles in order to obtain the consecutive pipe curves in planes corresponding to such turning angles.

In an example of the instant invention, two auxiliary supports 85 and 78 are provided; they are included within the component parts which are indicated respectively with the reference numbers 80 and 70.

The component part 80 is formed by a base 81 placed on the side of the carrying structure 11 which corresponds to the progress of a pipe p to be subjected to one or more consecutive bending operations. As one may better see in FIG. 9, this base 81 is enabled to slide horizontally because it is provided with slots 82 and can be locked in the suitable position by means of guiding and fastening screws 83, in other words into the position bringing the axis of the pipe p lying on the suitable V seating of the auxiliary support 85 to the vertical placing plane of the pipe between the matrix die 30 and the countermatrix die 31. To this possible horizontal displacement of the base 81 of the component part 80 one must add the possible horizontal displacement of the body 84 of the said component part 80 in order to ensure that the pipe resting on the suitable V seating remains in horizontal alignment with the centres of the counterposed grooves of the matrix die and countermatrix die 30 and 31, and of the counterposed grooves of the rectilinear length 30*b* of the matrix die 30 as well as of the facing support 33 installed on the component part 32, as is better shown in FIG. 6.

This horizontal alignment of the pipe to be bent is made continuous, even at a relatively great distance, by means of an auxiliary support 78 formed by a bush with a central through hole to permit the through passing by force of the pipe p to be bent, which thus is kept integral with the supporting bush 78. This supporting bush 78 is provided with support on the appropriate V seating formed by a thin angle 71 folded in such a way as to create the desired V supporting element starting from the above mentioned base 81, and having its end fastened on the latter by means of some screws 86, with the intention to create a very small moment of flexure of the protruding part 74 of the V profile 71, and also in order to create two side wings 72 and 73.

The bushing 78 is provided with a constant outside diameter, for pipes having different outside diameters—even the smaller ones and provided with cores in order to have an easier bending—for each one of them therefore the bushing 78 is provided with a central through hole having the appropriate diameter, through which the pipe is introduced by forced pushing, in order to render the pipe integral with it, from the centres of the grooves of 30–31 and of 30–33, centres which, as is already clear from the above, always lie on this same plane which is perpendicular to the turning axis of the main shaft 36, a plane being provided at a constant level, whatever the interchangeable matrix die 30 may be and consequently the countermatrix die 31 may be. The outside perimeter surface of the bushing 78 is provided with an angular graduation in order to ensure that the operator may read, by means of the fixed line 77, the turning angle of the pipe around its axis, which is predetermined in order to perform its bending according to the plane corresponding to it.

In FIGS. 6 and 8, the line 77 is defined by a metal strap 76 which is appropriately bent in order to be placed and to enable it to slide along the above mentioned V seating of the profile 71 in such a way that its front border permits, in turn, reading its longitudinal position by means of the graduation provided on the wing 73 of the profile 71, a position corresponding to that already predetermined in order to perform on the pipe p one of the consecutive bending operations whose plane is previously determined by reading, as described above, the relevant angle on the graduation of the outside perimetral surface of the bushing 78, by means of the line 77 on the metal strap 76.

We claim:

1. A portable pipe bending machine to bend pipes up to an angle of 180°, in the range of outside diameters from about 4 mm to 42 mm, and of thicknesses from about 0.5 mm to 2.5 mm, comprising:

(a) a main carrying structure (11) of a light alloy in the form of a parallelepiped box, with a hollow base (12) and two superposed structural component parts (13, 14) wherein a mechanical transmission and drive system and control system are arranged; a cover (14) of the said structure (11) having a protruding part (15) providing a support plane (15') as a supporting and sliding base of a rack (16) between parallel side guides for the positioning of a countermatrix die (31), and from said cover emerging a main shaft (50) on which a matrix die (30) is rotatable about an axis perpendicular to said rack;

(b) said matrix die (30) having for at least about 180° a pulley shape (**30*a*) with a semicircular groove and a perimetral profile having a tangential extension (30*b*) along a feeding direction of a pipe to be bent, said matrix die (30) being assembled for free turning on a cylindrical end (52') of said main shaft (50**);

(c) a shaped component part (32) for rotating said matrix die (30), provided with an eccentric polygonal hole (32') and assembled on an equally eccentrical polygonal length (52) of said main shaft (50), said shaped component part having a slot (35) in which is disposed a pivot pin (34) of an auxiliary support (33) having a groove (**33*a*) facing said groove of said matrix die (30) along said tangential extension (30*b*) said slot (35) permitting interchanging and positioning of said auxiliary support (33**) in accordance with the outside diameter of the pipe to be bent;

(d) said rack (16) having teeth (18), and a slider (19) with teeth (21) having a shape and a pitch suitable for meshing with the rack teeth (18); the said rack (16) being slidable along said plane (15') by means of a connection (16') having a free end that carries a wheel (38) rolling on a beginning incline (37) and a consecutive inside perimetral border of a gear wheel (36) of said mechanical transmission thereby to cause said main shaft (50) to turn; said slider (19) being slidable on parallel guides arranged on and parallel to said rack (16), said countermatrix die (31) being mounted on a pin (20) for movement with said slider (19) toward and away from said matrix die (30) when said slider teeth (21) are disengaged from said rack teeth (18);

(e) said countermatrix die (31) comprising a substantially parallelepipedal body, a side of which has a protruding part (31') provided with a through hole with an axis parallel to said side, for assembling said body on said pin (20) of said slider (19), an opposite side of said parallelepipedal body having a shape for receiving the pipe to be bent.

2. Pipe bending machine in accordance with claim 1, mounted on a tripod (60) for positioning movements around an axis (X—X) perpendicular to said plane (15') by means of a coupling (61) and locking hand grip (62), and for angular movement around an axis (Y—Y) perpendicular to the first-mentioned plane (15'), by means of a screw pin (63) and locking wing nut (64).

3. Pipe bending machine in accordance with claim 1, having a graduated disc (55) for the previous adjustment of the bending angle, which is frictionally mounted on an extension shaft (53) integral with said main shaft (50), by means of a friction bushing (57), a friction washer (58) and a centering bushing (57') and with fastening by means of a self-locking nut (59); said disc (55) having an arc-shaped element with a raised level (56) and with an incline (56') to operate a bending end switch of an electrical control means, and said main shaft (50) having a cam (54) to operate a return end switch of said electrical control means.

4. Pipe bending machine in accordance with claim 1, wherein said rack (16) is guided, in its sliding in said plane (15') by means of opposite dovetail grooves (16''); and that a sliding way with opposite dovetail grooves (19') is provided along said rack (16) for said slider (19).

5. Pipe bending machine in accordance with claim 1, wherein in said slider (19) a hole with steps is provided for the insertion and the axial sliding of a pin (20') whose end has teeth (21) to position and to lock said slider, and a hand grip (25) for engaging and disengaging said teeth (21) with said teeth (18) on said rack (16).

6. Pipe bending machine in accordance with claim 1, including also an auxiliary V support (85) as a supporting seating of the pipe to be bent, which is disposed at the upper end of a flat part (84) sliding vertically between vertical parallel guides, and a base (81) for said flat part (84) which is horizontally positionable by guiding and fastening pins (83) movable within horizontal grooves (82) of said base (81).

7. Pipe bending machine in accordance with claim 6, including also a long auxiliary support (74) in form of a V, with linear graduation along one side (73) and angular graduation on a bushing (78) adapted to be carried by a pipe (p) sliding in said long auxiliary support (74).

* * * * *